US011255317B2

(12) United States Patent
Weimer et al.

(10) Patent No.: US 11,255,317 B2
(45) Date of Patent: Feb. 22, 2022

(54) THICK MATERIAL PUMP

(71) Applicant: Putzmeister Engineering GmbH, Aichtal (DE)

(72) Inventors: Ralf Weimer, Stuttgart (DE); Patrick Stein, Filderstadt (DE)

(73) Assignee: Putzmeister Engineering GmbH, Aichtal (DE)

( * ) Notice: Subject to any disclaimer, the term of this patent is extended or adjusted under 35 U.S.C. 154(b) by 196 days.

(21) Appl. No.: 16/317,925

(22) PCT Filed: Jun. 13, 2017

(86) PCT No.: PCT/EP2017/064416
§ 371 (c)(1),
(2) Date: Jan. 15, 2019

(87) PCT Pub. No.: WO2018/015070
PCT Pub. Date: Jan. 25, 2018

(65) Prior Publication Data

US 2019/0293060 A1 Sep. 26, 2019

(30) Foreign Application Priority Data

Jul. 22, 2016 (EP) ..... 16180791

(51) Int. Cl.
*F04B 15/02* (2006.01)
*F04B 7/00* (2006.01)
*F04B 17/06* (2006.01)

(52) U.S. Cl.
CPC ..... *F04B 15/02* (2013.01); *F04B 7/0015* (2013.01); *F04B 7/0034* (2013.01); *F04B 15/023* (2013.01); *F04B 17/06* (2013.01)

(58) Field of Classification Search
CPC ..... F04B 11/005; F04B 15/00; F04B 15/02; F04B 15/023; F04B 7/007; F04B 7/0015;
(Continued)

(56) References Cited

U.S. PATENT DOCUMENTS 3,298,322 A * 1/1967 Sherrod ..... F04B 15/023 417/517
3,663,129 A * 5/1972 Antosh ..... F04B 11/005 417/516
(Continued)

OTHER PUBLICATIONS

International Search Report dated Sep. 6, 2017 for International Patent Application No. PCT/EP2017/064416.

*Primary Examiner* — Nathan C Zollinger
(74) *Attorney, Agent, or Firm* — Alix, Yale & Ristas, LLP

(57) ABSTRACT

The invention relates to a thick material pump having a first delivery cylinder, a second delivery cylinder and an additional cylinder. The additional cylinder serves for bridging a transition between the first delivery cylinder and the second delivery cylinder. The thick material pump comprises a movable tube portion which forms a connection between the first delivery cylinder and an outlet of the thick material pump in a first state and which forms a connection between the second delivery cylinder and the outlet of the thick material pump in a second state. The movable tube portion comprises a switchable closure which is arranged between an inlet end of the movable tube portion and the additional cylinder. The thick material pump according to the invention makes it possible for a uniform material flow to be delivered in the direction of the pump outlet.

16 Claims, 4 Drawing Sheets

(58) Field of Classification Search
CPC ..... F04B 17/06; F04B 7/0007; F04B 7/0258; F04B 7/0034; Y10S 417/90; E03B 1/042; F17D 1/00; B67D 1/10
See application file for complete search history.

(56) References Cited

U.S. PATENT DOCUMENTS

| | | | | |
|---|---|---|---|---|
| 3,963,385 | A * | 6/1976 | Caban | F04B 7/0034 417/517 |
| 4,533,300 | A * | 8/1985 | Westerlund | F04B 15/023 417/339 |
| 5,316,453 | A | 5/1994 | Schwing | |
| 2015/0330374 | A1 | 11/2015 | Hudelmaier | |

* cited by examiner

THICK MATERIAL PUMP

BACKGROUND

The invention relates to a thick material pump having a first delivery cylinder, a second delivery cylinder and an additional cylinder. The additional cylinder is configured to bridge a delivery gap between the first delivery cylinder and the second delivery cylinder. The delivery pump comprises a movable tube section which, in a first state, forms a connection between the first delivery cylinder and an outlet of the thick material pump and which, in a second state, forms a connection between the second delivery cylinder and the outlet of the thick material pump.

Such pumps serve to deliver thick materials, such as for example fresh concrete or mortar. The delivery cylinders suck the thick material out of a reservoir with a rearward movement. The thick material is delivered in the direction of an outlet of the thick material pump with a forward movement.

The delivery cylinders are alternately connected to the outlet of the thick material pump with the movable tube section. The respective other delivery cylinder is not connected to the outlet in this phase but rather can suck in thick material from the reservoir with the rearward movement.

If the forward movement of the first delivery cylinder is ended, the movable tube section is switched over to the second delivery cylinder. During the transition from the first delivery cylinder to the second delivery cylinder there is an interruption in the flow of material owing to the changing between the delivery cycles of the delivery cylinders.

By means of the additional cylinder, the transition between the two delivery cylinders is bridged in that the additional cylinder delivers thick material in the direction of the pump outlet during the switching over of the tube section. It therefore becomes possible to generate an essentially continuous flow of material in the direction of the pump outlet, DE 42 08 754 A1, U.S. Pat. No. 3,963,385. In this context, a backflow of the material delivered by the additional cylinder can occur into one of the delivery cylinders.

SUMMARY OF THE INVENTION

In the invention, the object is based on presenting a thick material pump with which a uniform flow of material can be generated in the direction of the pump outlet. Taking the abovementioned prior art as a basis, the object is achieved with the features of claim 1. Advantageous embodiments are specified in the dependent claims.

According to the invention, the movable tube section comprises a switchable closure which is arranged between an inlet end of the movable tube section and the additional cylinder.

Since a switchable closure is integrated into the movable tube section, the distance from the additional cylinder to the delivery cylinders can be closed when the additional cylinder delivers thick material. This can prevent a backflow from the additional cylinder in the direction of the delivery cylinders.

The movable tube section can extend from the inlet end to an outlet end. The specifications inlet and outlet relate to the direction of movement of the flow of material which is set in train with the forward movement of a delivery cylinder. The movable tube section can be rigid, with the result that the inlet end or the outlet end have a fixed spatial relationship with respect to one another. Embodiments in which the tube section is movable in itself, that is to say in which the position of the inlet end can be moved relative to the position in the outlet end, are also possible.

The tube section can be mounted so as to be movable relative to a supporting structure of the thick material pump. The bearing arrangement can comprise a rotary bearing around which the tube section can be rotated. The rotary bearing can be oriented concentrically with respect to an outlet end of the tube section. An end face of the tube section which forms the outlet end can be oriented perpendicularly with respect to the rotational axis. As a result, the tube section can be coupled independently of its rotational position to a connecting tube which is arranged in a fixed position.

The inlet end of the tube section can be arranged offset in the radial direction with respect to the axis of the rotary bearing. The inlet end of the tube section then changes position when the tube section is rotated. During the subsequent arrangement of the delivery cylinders, the inlet end can optionally be coupled to the first delivery cylinder or to the second delivery cylinder by rotational movement of the tube section. An end face of the tube section which forms the inlet end can be oriented perpendicularly with respect to the rotational axis.

The tube section can comprise a branch which leads off to the additional cylinder, with the result that the additional cylinder is accessible from the interior of the tube section. It is therefore possible to offset or keep moving the flow of material of the thick material in the tube section with a forward movement of the additional cylinder. Since the branch is arranged in the movable tube section, there are short distances between the delivery cylinders, the additional cylinder and the switchable closure, which is advantageous for generating a continuous flow of material.

Thick material is a generic term for media which are difficult to deliver. Thick material may be, for example, a material with coarsely grained components, a material with aggressive components or the like. The thick material can also be a bulk material. In one embodiment, the thick material is fresh concrete. Fresh concrete can contain grains up to a size of more than 30 mm, hardens, forms deposits in dead spaces and is difficult to deliver for these reasons.

Since the switchable closure is a component of the movable tube section, the movable tube section can be switched over without the switched position of the closure being changed. In particular, the tube section can comprise a first partial section which extends between the inlet end and the closure, and a second partial section which extends between the closure and the branch. The closure can be switchable, with the result that in a first state it permits the flow of material to pass through from the delivery cylinder in the direction of the outlet end of the tube section, and so that in a second state it prevents a backflow of material from the branch in the direction of the inlet end.

The closure can comprise a gate valve, which in a first position clears the cross section of the tube, and in a second position closes off the tube. The gate valve can be mounted so as to be rotatable with respect to a pivoting axis, with the result that it can change between the two positions by rotating about the pivoting axis. It can be advantageous for simple activation of the gate valve if the pivoting axis of the valve coincides with the rotational axis of the tube section. Other mechanisms for moving the valves are also possible. For example, the gate valve can be moved in a translatory fashion in order to change between the two positions.

Combinations of rotary and translatory movements are also possible. In all cases, the movement can take place in the plane of the gate valve.

The invention includes embodiments in which the additional cylinder is fixedly connected to the movable tube section. In such embodiments, the additional cylinder also moves when the tube section is moved. In order to keep the moved masses low, it can be advantageous if the additional cylinder is connected to the supporting structure of the thick material pump, with the result that the tube section can be moved independently of the additional cylinder.

The thick material pump according to the invention can be configured in such a way that the connection between the interior of the tube section and the additional cylinder continues to be maintained in any rotational position which the tube section assumes during operation of the pump. Thick material can then be fed in the direction of the outlet end of the pump with the additional cylinder independently of the rotational position of the tube section. In particular, the tube section can have an opening which is coaxial with respect to the rotational axis of the tube section and which is adjoined by the additional cylinder.

The movable tube section can form a linear path which extends from an opening facing the additional cylinder as far as the outlet end of the tube section. The linear path can extend parallel to the rotational axis of the tube section and can be, in particular, coaxial with respect to the rotational axis. The coaxial arrangement has the advantage that the forces acting on the tube section are low while the tube section is rotated about the rotational axis and while the additional cylinder feeds material through the tube section.

The path which starts at the inlet end can enclose, with the branch leading to the additional cylinder, an angle which is less than 90°, preferably less than 60°, and more preferably less than 45°. Such an acute angle has the advantage that the flows of material coming from the additional cylinder and the delivery cylinders can be combined well to form a common flow of material.

The thick material pump according to the invention can be configured in such a way that the two delivery cylinders are activated in opposing directions. This means that the forward movement of a piston which is arranged in the one delivery cylinder takes place at the same time as the rearward movement of a piston which is arranged in the other delivery cylinder. In particular, the opposing movements can be synchronized. The forward movement of the one delivery cylinder can start at the same time at which the rearward movement of the other delivery cylinder starts. The forward movement of the one delivery cylinder can end at the same time at which the rearward movement of the other delivery cylinder ends. The absolute value of the speed can be the same at any time.

The activation of the delivery cylinders can be adjusted to the movement of the tube section. The tube section can therefore be connected to the first delivery cylinder when the forward movement of the first delivery cylinder takes place. The access to the second delivery cylinder can be free in this first state, with the result that the second delivery cylinder can suck in thick material from the reservoir with its rearward movement.

The tube section can be connected to the second delivery cylinder when the forward movement of the second of responder takes place. The access to the first delivery cylinder can be clear in the second state, with the result that with its rearward movement the first delivery cylinder can suck thick material out of the reservoir.

The closure with which a backflow from the additional cylinder in the direction of the delivery cylinder is prevented can also be adjusted to the delivery cylinders or to the tube section. In particular, the closure can be switched in such a way that it permits a free passage through the tube section if either the first delivery cylinder or the second delivery cylinder is in the forward movement.

The closure can close off the tube section between the inlet end and the branch while the tube section is switched over between the first delivery cylinder and the second delivery cylinder. It is possible to provide a time period during the switching over of the tube section, in which time period the piston of the first delivery cylinder and/or the piston of the second delivery cylinder are at rest. The time period can extend over the entire duration of the switching over process.

The delivery cylinder to which the tube section is coupled after the switching over can build up a pressure with an initial forward movement of the piston before the closure is switched over. As a result, it is possible to reduce the pressure difference which is present across the closure during the switching over.

The additional cylinder can be configured in such a way that it carries out a forward movement while the closure is in the closed state. In particular, the forward movement can extend over the entire time period in which the closure is in the closed state. The start of the forward movement of the additional cylinder can overlap with the end of the forward movement of a delivery cylinder. The end of the forward movement of the additional cylinder can overlap with the start of the forward movement of the other delivery cylinder. The additional cylinder and the delivery cylinders can be adjusted to one another in such a way that the sum of the required quantities of material is approximately the same over time. It is then possible to deliver a constant flow of material in the direction of the pump outlet. In particular, it is possible to reduce the speed of the forward movement, both at the additional cylinder and at the delivery cylinders if a further cylinder of the cylinder is carrying out the forward movement.

An active drive, for example in the form of a hydraulic drive, can be provided for the forward movement of the piston which is arranged in the additional cylinder. The rearward movement of the piston can also be carried out by the active drive. It is also possible for the piston to be moved back passively by the pressure of the material located in the tube section. The additional cylinder is then fed by a flow of material which is generated by the delivery cylinders. Both the forward movement and the rearward movement can be driven actively at the first delivery cylinder and at the second delivery cylinder. The drive can be, for example, a hydraulic drive.

The movable tube section can extend through a pre-filling container. During operation of the pump, the quantity of thick material which is equivalent to the quantity which can be fed in the direction of the pump outlet by the delivery cylinders can be subsequently filled into the pre-filling container. During the rearward movement, the delivery cylinders can be connected to the pre-filling container, with the result that they can suck in thick material from the pre-filling container.

In particular, the inlet end of the tube section can be arranged within the pre-filling container. The outlet end of the tube section can be arranged inside or outside the pre-filling container. The movable tube section can be mounted with two rotary bearings. The distance between the two rotary bearings can extend through the pre-filling container. The drive for the movement of the tube section and/or the drive for the movement of the closure can be arranged outside the pre-filling container. In particular, one of the drives can be arranged on the one side of the pre-filling container, and the other drive can be arranged on the other side of the pre-filling container.

The drive for the switchable closure can be supported on a structure of the thick material pump, with the result that the closure can be moved relative to the structure by the drive. This structure can be the supporting structure of the thick material pump. If the switched state of the closure remains unchanged during the switching over of the movable tube section, the drive of the switchable closure can be passively entrained during the movement of the tube section.

Alternatively, the drive for the switchable closure can be supported on the structure which forms part of the movable tube section. During the switching over process of the tube section, the switchable closure and its drive are then moved entirely, with the result that when the movable tube section is switched over the switched state of the closure and the state of the associated drive remain unchanged. This reduces the mechanical complexity, however more mass has to be moved when switching over the tube section.

The drive of the switchable closure can be configured in such a way that it is activated only when the movable tube section is at rest. It is also possible for the switching movements of the closure to be superimposed on the switching movement of the movable tube section.

The pre-filling container and the delivery cylinders can be connected to the supporting structure of the thick material pump, with the result that they are in a fixed spatial relationship with one another. The delivery cylinders can be oriented parallel to one another and be arranged at the same height. The orientation of the delivery cylinders can be parallel to the rotational axis of the tube section. The rotational axis of the tube section can be arranged centrally within the delivery cylinders and above the delivery cylinders. The additional cylinder can be arranged parallel to the delivery cylinders.

The thick material pump can comprise precisely two delivery cylinders. It is then switched over alternately from the first to the second delivery cylinder and from the second to the first delivery cylinder. If the thick material pump comprises more than two delivery cylinders, the movable tube section can be switched over cyclically between the delivery cylinders. In all cases, the additional cylinder can be configured in such a way that it bridges each of the transitions.

The term delivery cylinder is to be understood in a functional way. The invention also includes embodiments in which the two delivery cylinders are, according to the invention, combined in one physical cylinder, wherein either two pistons move in the same cylinder, or one piston carries out a forward movement according to the invention in both directions of movement. In one preferred embodiment, the pump comprises two cylinders which are physically separated from one another and which form the two delivery cylinders.

The movable tube section and the additional cylinder can be elements of one unit which is detachably connected to the thick material pump. This can facilitate the maintenance and cleaning of the thick material pump according to the invention.

The thick material pump can comprise an alternative operating mode in which only the two delivery cylinders are in operation, while the additional cylinder is not in operation. This operating mode can be an emergency mode.

BRIEF DESCRIPTION OF THE DRAWINGS

The invention will be described by way of example below with reference to the appended drawings and by means of additional embodiments. In the drawings.

DETAILED DESCRIPTION

Figure 1:
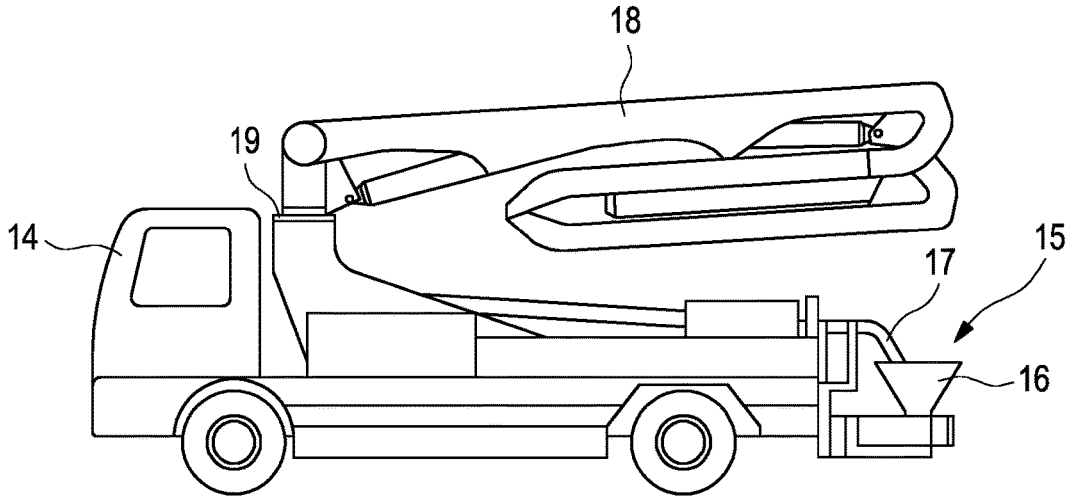
FIG. 1 shows a vehicle which is equipped with a thick material pump according to the invention.

A thick material pump 15 in the form of a concrete pump is arranged on the truck bed of a truck 14 which is shown in FIG. 1. The thick material pump 15 comprises a pre-filling container 16 into which the concrete is filled from a reservoir (not illustrated). The thick material pump 15 sucks the concrete out of the pre-filling container and feeds the concrete through a connection tube 17 which extends along a distributor mast 18. The distributor mast 18 is mounted on a live ring 19 and can be folded out by means of a plurality of joints, with the result that the end of the tube 17 can be moved into a position in which it is spaced apart from the truck 14. In this position, the concrete is discharged from the connection tube 17. Embodiments which are arranged on a stationary frame (not illustrated) are also included.

Figure 2:
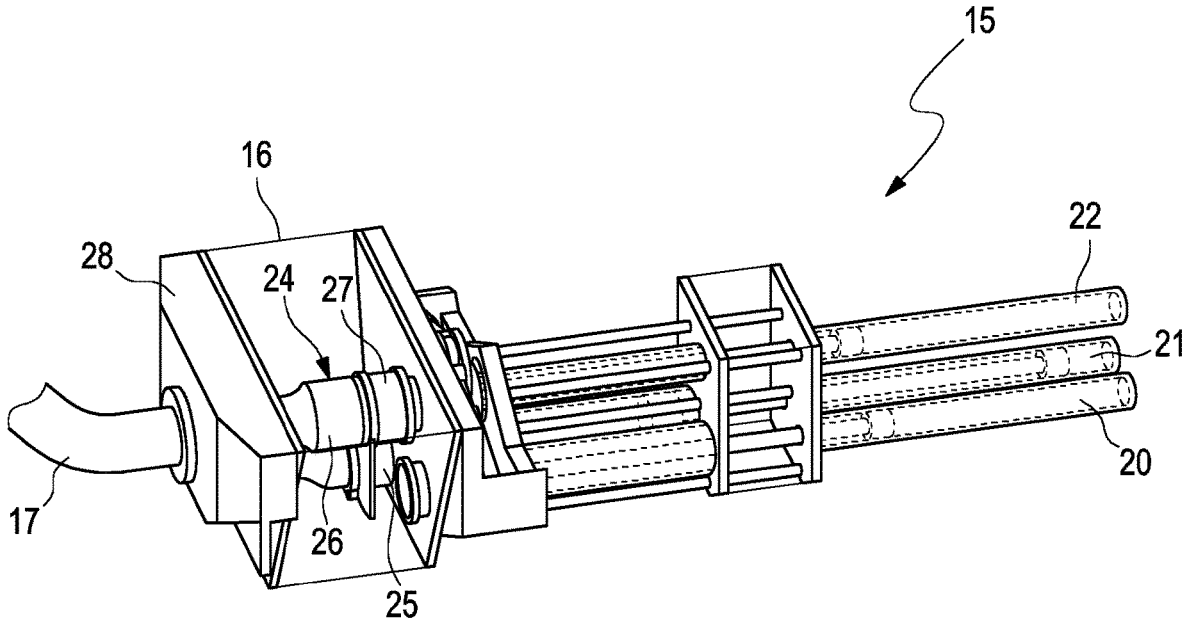
FIG. 2 shows a schematic illustration of a thick material pump according to the invention.

According to FIG. 2, the thick material pump 15 comprises, adjacent to the pre-filling container 16, a first delivery cylinder 20, a second delivery cylinder 21 and an additional cylinder 22. A movable tube section 24 extends between the connection tube 17, which is connected to the outlet of the thick material pump, and the delivery cylinders 20, 21. The movable tube section 24 comprises an outlet end 23 which is arranged coaxially with respect to the connection tube 17 and is connected to the connection tube 17 by means of a rotary bearing. The rotary bearing defines a rotational axis about which the tube section 24 can be rotated.

The inlet end 25 of the movable tube section 24 is spaced apart radially from the rotational axis. The position of the inlet end 25 is therefore changed if the movable tube section 24 is rotated about the rotational axis. In a first rotational position of the tube section 24, the inlet end 25 is aligned with the first delivery cylinder 20. In a second rotational position of the tube section 24, the inlet end 25 is aligned with the second delivery cylinder 21. The respective other delivery cylinder is accessible from the pre-filling container 16.

In the state shown in FIG. 2, the first delivery cylinder 20 can suck concrete out of the pre-filling container 16 with a rearward movement of its piston. The second delivery cylinder 21 can feed, with a forward movement of its piston, concrete located in the interior of the delivery cylinder 21 into the connection tube 17 through the tube section 24. After the end of the forward movement of the second delivery cylinder 21, the movable tube section 24 is switched over, with the result that the inlet end 25 is connected to the first delivery cylinder 20, and that the second delivery cylinder 21 is open toward the pre-filling container 16. The first delivery cylinder 20 can then feed, with a forward movement, concrete into the connection tube 17 through the tube section 24, while the second delivery cylinder 21 sucks in concrete from the pre-filling container 16 with a rearward movement.

During the switching over process, with which the movable tube section 24 is switched over between the two delivery cylinders 20, 21, neither of the two delivery cylinders 20, 21 can feed concrete into the tube section 24. In order to prevent an interruption in the flow of material in this phase, the thick material pump according to the invention is equipped with the additional cylinder 22. The additional cylinder 22 is connected to a branch 26 of the movable tube section 24, with the result that the additional cylinder 22 can feed, with a forward movement of its piston, concrete into the connection tube 17 through the tube section 24. The phase in which none of the delivery cylinders 20, 21 can feed concrete into the connection tube 17 is therefore bridged with the additional cylinder 22, with the result that in this phase it is also possible to maintain the continuous flow of material in the direction of the connection tube 17.

In order to prevent the concrete which is fed with the additional cylinder 22 from flowing back in the direction of the delivery cylinders 20, 21, the movable tube section 24 is equipped with a gate valve 27. The gate valve 27 is arranged between the branch 26 and the inlet end 25 of the movable tube section 24. The gate valve 27 is switched in such a way that it clears the path through the tube section 24 when one of the delivery cylinders 20, 21 completes a forward movement, and that it closes off the path through the tube section 24 if switching over between the delivery cylinders 20, 21 is carried out. In this phase, concrete can be fed in the direction of the connection tube 17 with the additional cylinder 22.

Figure 7A:
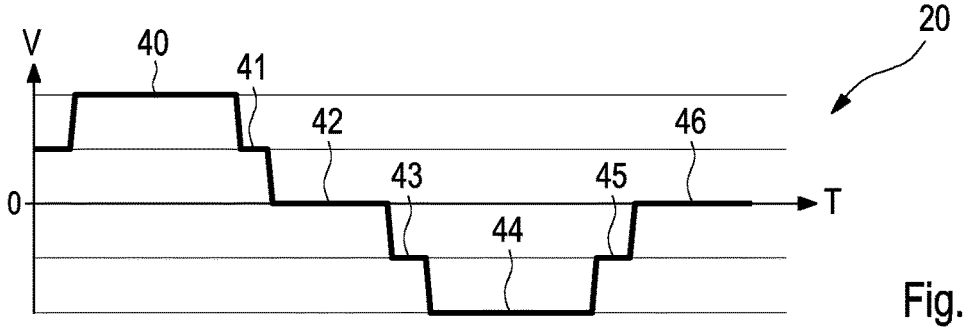
FIG. 7 shows a clock diagram of various components of the thick material pump according to the invention.
Figure 7B:
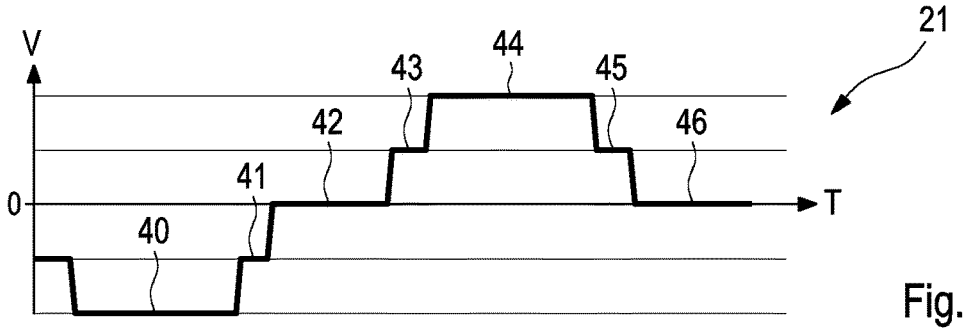
Figure 7C:
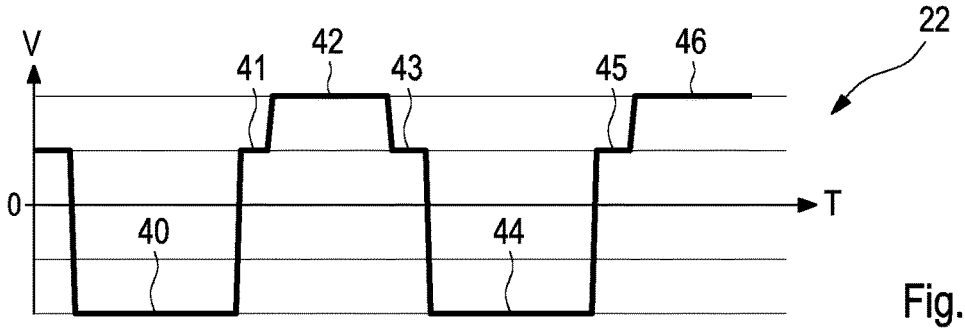

A possible method sequence when operating the pump according to the invention is explained below with reference to FIGS. 3 to 7. In FIG. 7A, the speed V of the movement of the first delivery cylinder 20 is plotted against the time T. FIGS. 7B and 7C correspondingly illustrate the movement of the second delivery cylinder 21 and of the additional cylinder 22. A forward movement is illustrated in FIG. 7A to FIG. 7C by means of a value above the zero line, and a value below the zero line corresponds to a rearward movement.

Figure 7D:
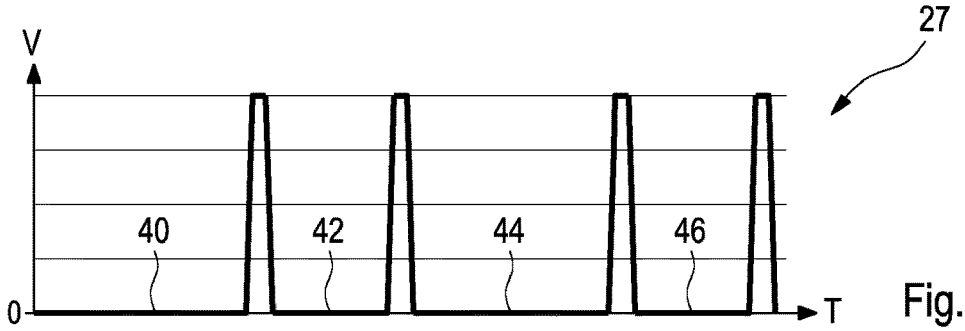
Figure 7E:
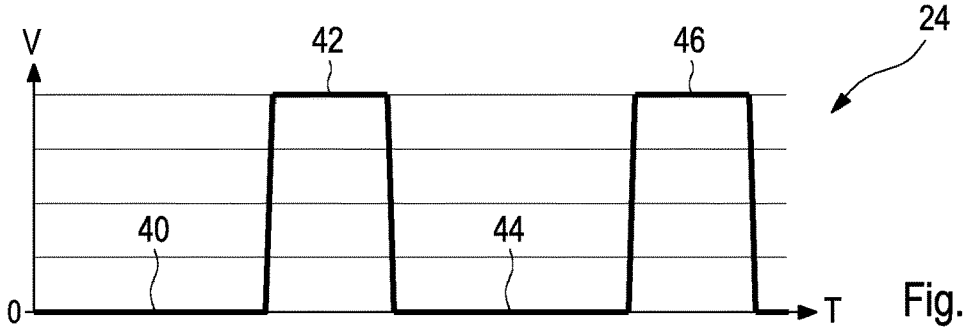

In FIG. 7D, the movement of the gate valve 27 is shown, and in FIG. 7E the movement of the movable tube section 24. The illustration in FIGS. 7D and 7E is not direction-dependent; in each case both switching directions are illustrated by a value above the zero line.

Figure 3:
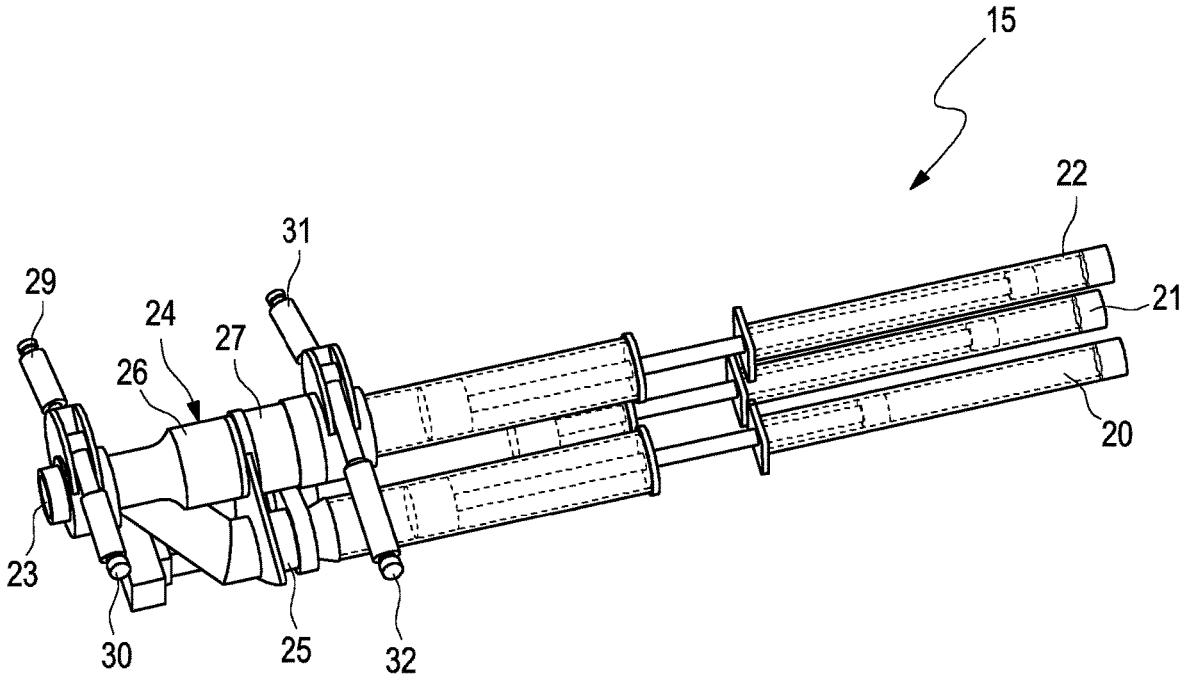
FIGS. 3 to 6 show a schematic illustration of various operating states of the thick material pump according to the invention.

The state according to FIG. 3 corresponds to the phase 40 in FIG. 7. The piston of the first delivery cylinder 20 (FIG. 7A) carries out a forward movement, while the piston of the second delivery cylinder 21 (FIG. 7B) carries out a rearward movement. The gate valve 27 (FIG. 7D) is switched in such a way that the path through the tube section 24 is clear. The tube section 24 (FIG. 7E) is coupled to the first delivery cylinder 20.

In the phase 40, the first delivery cylinder 20 feeds concrete to the connection tube 17 through the tube section 24. The second delivery cylinder 21 sucks concrete out of the pre-filling container 16, with the result that the interior of the second delivery cylinder is filled with concrete. The piston of the additional cylinder 22 is forced to the rear by the pressure present within the tube section 24. The additional cylinder 22 therefore carries out a rearward movement (FIG. 7C) and therefore also takes up concrete into its interior.

In the phase 41, the first delivery cylinder 20 (FIG. 7A) is just before the end of its forward movement, and the speed of the forward movement is reduced to half. The flow of material which is fed with the first delivery cylinder 20 is decreased. At the same time, the additional cylinder 22 (FIG. 7C) is given a forward movement with a reduced speed, with the result that the flow of material in total remains the same.

Figure 4:
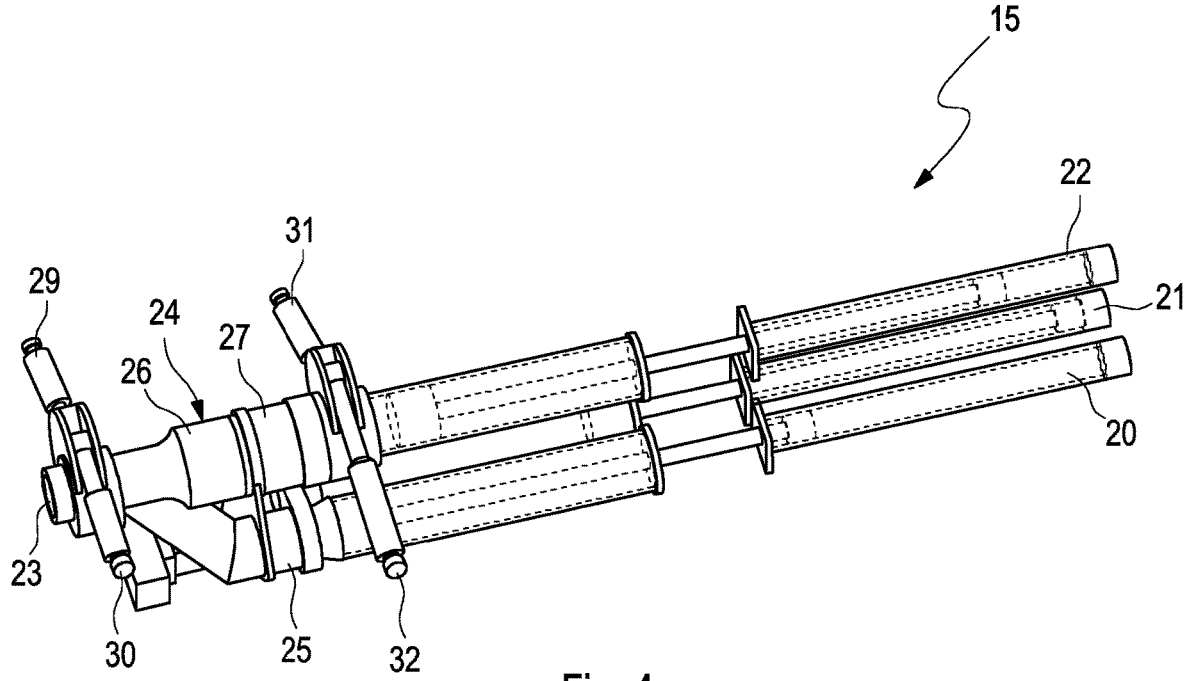

At the end of the phase 41, the gate valve 27 is activated, with the result that in phase 42 it closes off the path through the tube section 24. The forward movement of the first delivery cylinder 20 ends, and the first delivery cylinder 20 remains at rest in phase 42. The additional cylinder 22 (FIG. 7C) is moved forward with an increased speed in phase 42, with the result that said additional cylinder 22 alone maintains the desired flow of material. In phase 42, the movable tube section 24 (FIG. 7E) is switched over from the first delivery cylinder 20 to the second delivery cylinder 21. FIG. 4 shows the state just before the switching over of the tube section 24 in which the gate valve 27 is already switched over, but the tube section 24 is still connected to the first delivery cylinder 20.

Figure 5:
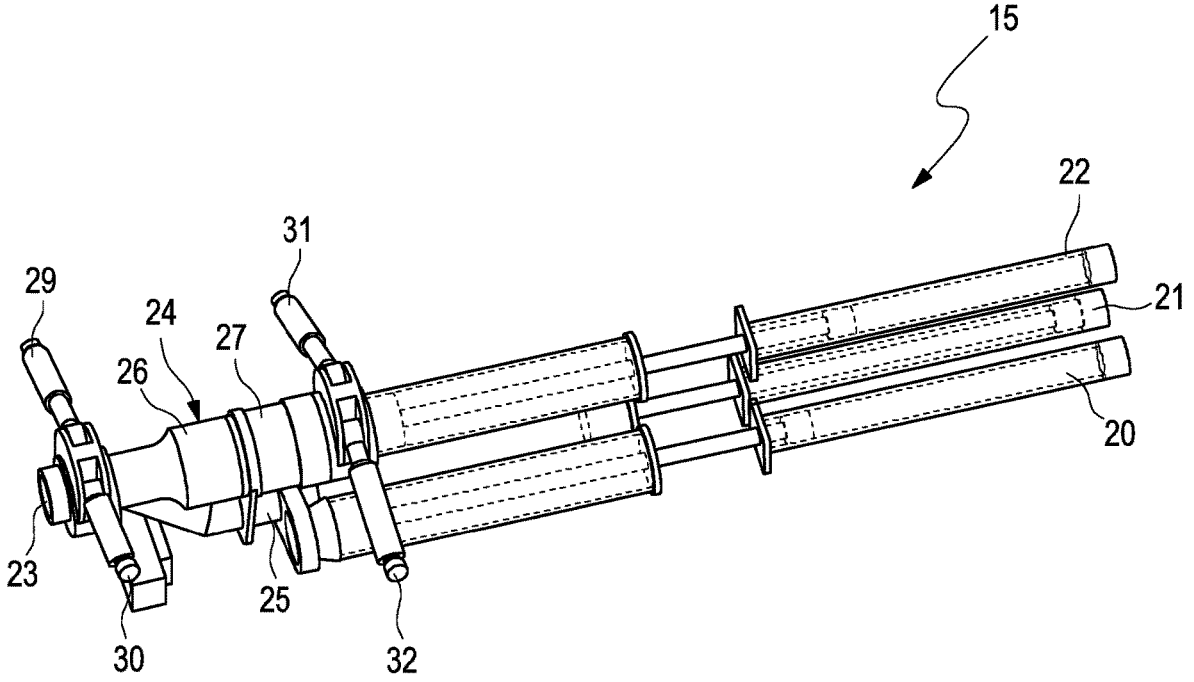
Figure 6:
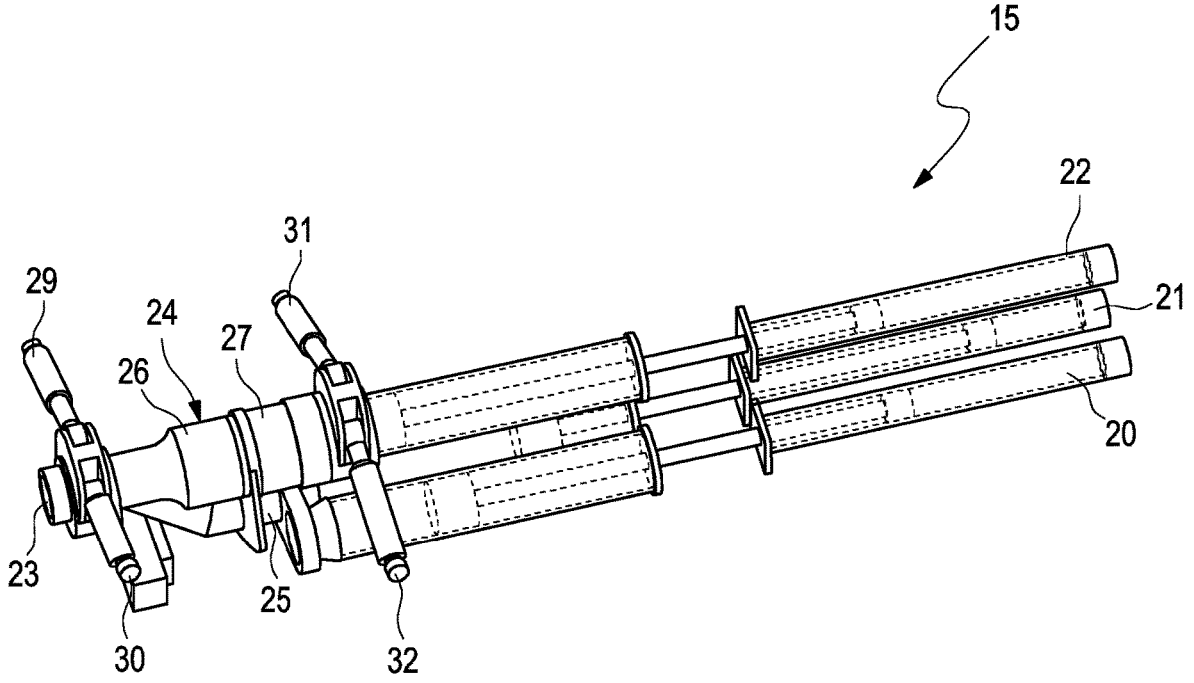

After the tube section 24 is switched over to the second delivery cylinder 21, the forward movement of the second delivery cylinder 21 starts in phase 43 (FIG. 7B). This state of the pump in which the forward movement of the second delivery cylinder 21 starts, but the gate valve 27 is still closed, is illustrated in FIG. 5. As soon as the second delivery cylinder 21 has built up a first pressure, the gate valve 27 (FIG. 7D) is activated, with the result that it clears the path through the tube section 24 again. The second delivery cylinder 21 and the additional cylinder 22, which are both moved forward at a reduced speed, together generate the desired flow of material in the direction of the tube 17.

In phase 44, the second delivery cylinder 21 moves forward at full speed, whereby the additional cylinder 22 is given a rearward movement. At the same time, with a rearward movement the first delivery cylinder sucks in concrete from the pre-filling container 16, see FIG. 6. The phase 44 therefore corresponds to the phase 40, wherein the states of the first delivery cylinder 20 and of the second delivery cylinder 21 are interchanged.

The forward movement of the second delivery cylinder 21 ends in phase 45 in which the piston of the second delivery cylinder 21 is moved forward at a reduced speed. At the same time, the additional cylinder 22 is moved forward at a reduced speed, with the result that the flow of material is maintained unchanged. At the end of the phase 45, the gate valve 27 is activated, with the result that in phase 46, in which the two delivery cylinders 20, 21 are at rest, the tube section 24 can be switched over again to the first delivery cylinder 20. The sequence starts from the beginning after the gate valve 27 is opened again.

This sequence is based on the following design of thick material pump according to the invention. The branch 26, leading to the additional cylinder 22, of the tube section 24 is arranged coaxially with respect to the rotational axis of the tube section 24. The additional cylinder 22 is arranged as a prolongation of the branch 26. The tube section 24 is supported by a first rotary bearing which is arranged at the outlet end 23 of the tube section 24, and by a second rotary bearing which is arranged between the branch 26 of the tube section 24 and the additional cylinder 22. The tube section 24 extends between the two rotary bearings, through the pre-filling container 16. The gate valve 27 is supported by a further rotary bearing which is coaxial with respect thereto. The rotary bearing of the gate valve 27 is connected to the branch 26 of the tube section 24, with the result that the position of the gate valve 27 in the tube section 24 remains unchanged when the tube section 24 is rotated.

The activation of the tube section 24 is carried out by means of a drive which is arranged in a housing part 28 of the pre-filling container. The drive comprises, according to FIGS. 3 to 6, two hydraulically activated cylinders 29, 30 which act on a lever of the tube section 24. The tube section 24 is rotated about the rotational axis by the one cylinder moving out and the other cylinder moving in. The drive 29, 30 is arranged in the direction of the rear of the vehicle when viewed from the pre-filling container 16.

The drive for the gate valve 27 is arranged on the other side of the pre-filling container 16. The drive also comprises two hydraulically activated cylinders 31, 32 which act on a lever of the gate valve 27. The hydraulically activated cylinders 31, 32 are moved along passively when the tube section 24 is rotated. Active activation of the cylinders 31, 32 causes the gate valve 27 to be moved relative to the tube section 24. The drive 31, 32 is arranged in the direction of the front of the vehicle when viewed from the pre-filling container 16.

The housing part 28 of the pre-filling container 16 forms one unit, together with the movable tube section 24, the gate valve 27, the two drives 29, 30, 31, 32 and the additional cylinder 22, which unit can be detached in its entirety from the thick material pump. This permits easy cleaning and maintenance of the pump.

The invention claimed is:

1. A thick material pump having a first delivery cylinder (20), a second delivery cylinder (21) and an additional cylinder (22) for bridging a transition between the first delivery cylinder (20) and the second delivery cylinder (21), and having a movable tube section (24) which, in a first position, forms a connection between the first delivery cylinder (20) and an outlet (23) of the thick material pump, and which in a second position forms a connection between the second delivery cylinder (21) and the outlet (23) of the thick material pump, wherein the movable tube section (24) comprises a switchable closure (27) which is arranged between an inlet end (25) of the movable tube section (24) and the additional cylinder (22), wherein the movable tube section (24) comprises a first partial section which extends between the inlet end (25) and the closure (27) and a second partial section which extends between the closure (27) and the additional cylinder (22).

2. The thick material pump of claim 1, wherein the tube section (24) is rotatable about a rotational axis oriented concentrically with respect to an outlet end (23) of the tube section (24).

3. The thick material pump of claim 1, wherein the closure (27) comprises a gate valve which can be moved in a rotary fashion between an open position permitting flow from said inlet end (25) to said outlet (23), and a closed position preventing backflow through said movable tube section (24).

4. The thick material pump of claim 1, wherein the closure (27) is pivotable about a pivoting axis oriented coaxially with respect to a rotational axis of the movable tube section (24).

5. The thick material pump of claim 3 wherein the closure (27) is opened if a piston of one of the delivery cylinders (20, 21) is moving forward, and in that the closure (27) is closed while the movable tube section (24) is moved between said first and second positions.

6. The thick material pump of claim 5, wherein each delivery cylinder (20, 21) includes a piston which feeds material in an interior of the delivery cylinder (20, 21) toward said movable tube section (24) with forward movement of the piston and draws material into the interior of the delivery cylinder (20, 21) with rearward movement of the piston, and the delivery cylinder (20, 21) to which the movable tube section (24) is coupled after the switching over of the tube section (24) builds up a pressure with an initial forward movement of the piston before the closure (27) is moved from the closed position to the open position.

7. The thick material pump of claim 6, wherein the pistons of the delivery cylinders (20, 21) are at rest while the tube section (24) is moved between said first and second positions.

8. The thick material pump of claim 1, wherein the tube section (24) comprises a branch (26) which communicates with the additional cylinder (22).

9. The thick material pump of claim 8, wherein the additional cylinder (22) is arranged coaxially with respect to a rotational axis of the tube section (24).

10. The thick material pump of claim 1, wherein the movable tube section (24) extends through a pre-filling container (16) of the thick material pump.

11. The thick material pump of claim 10, wherein a drive for moving the tube section (24) is arranged on a first side of the pre-filling container (16), and a drive for moving the closure (27) is arranged on a second side of the pre-filling container (16) opposite said first side.

12. The thick material pump of claim 1, wherein a flow of material coming from the delivery cylinders (20, 21) and a flow of material coming from the additional cylinder (22) are combined at an angle of less than 90°.

13. The thick material pump of claim 6, wherein said additional cylinder includes a piston that feeds material in an interior of the additional cylinder toward said outlet (23) and forward movement of the piston of the additional cylinder (22) overlaps with the end of the forward movement of the piston of the one delivery cylinder (20, 21) and with the start of the forward movement of the piston of the other delivery cylinder (20, 21).

14. The thick material pump of claim 1, wherein the additional cylinder (22) is fed by a flow of material which is generated by the delivery cylinders (20, 21).

15. The thick material pump of claim 1, wherein the movable tube section (24) and the additional cylinder (22) are elements of one unit which is detachably connected to the thick material pump.

16. The thick material pump of claim 13, wherein said switchable closure (27) is closed while the piston of the additional cylinder (22) is moving forward.

* * * * *